United States Patent [19]

Buchegger et al.

[11] 3,930,513

[45] Jan. 6, 1976

[54] SPRAY-CLEANING APPARATUS

[76] Inventors: Pius Buchegger; Pius Johann Buchegger, both of Altengutrathstrasse 200, Hallein, Austria

[22] Filed: Oct. 9, 1973

[21] Appl. No.: 404,426

[30] Foreign Application Priority Data

| | | |
|---|---|---|
| Oct. 10, 1972 | Austria | 8697/72 |
| Mar. 14, 1973 | Austria | 2230/73 |
| June 14, 1973 | Austria | 5256/73 |
| June 14, 1973 | Austria | 5257/73 |

[52] U.S. Cl. ..... 134/172; 134/144; 134/199

[51] Int. Cl.[2] ..... B08B 3/02

[58] Field of Search ..... 134/138, 139, 140, 141, 134/144, 148, 153, 172, 180, 181, 199

[56] References Cited

UNITED STATES PATENTS

| | | | |
|---|---|---|---|
| 1,080,704 | 12/1913 | Lilleberg | 134/172 |
| 1,143,217 | 6/1915 | McGrath | 134/148 X |
| 2,598,074 | 5/1952 | Sadwith | 134/148 X |
| 3,242,934 | 3/1966 | Heinicke et al. | 134/144 X |
| 3,452,763 | 7/1969 | Ballard | 134/139 X |

FOREIGN PATENTS OR APPLICATIONS

| | | | |
|---|---|---|---|
| 162,387 | 3/1958 | Denmark | 134/138 |
| 686,674 | 3/1965 | Italy | 134/144 |

*Primary Examiner*—Robert L. Bleutge
*Attorney, Agent, or Firm*—Kurt Kelman

[57] ABSTRACT

The apparatus serves to clean surfaces of articles by spraying a liquid cleaning fluid on said articles. A support is provided for carrying an article to be cleaned, also a nozzle system for spraying said cleaning fluid, and mechanism for moving said support and nozzle system relative to each other. The nozzle system comprises an upright nozzle tube disposed laterally of the support and above the same, an upper horizontal nozzle tube extending over the support, and a lower horizontal nozzle tube extending under the support. Each of said upright, upper and lower nozzle tubes have nozzles which are arranged in a longitudinal row and directed toward said support. Said upright and upper nozzle tubes and said support define a cleaning zone between them. Said nozzle system comprises an additional nozzle tube extending into said cleaning zone and having at least one longitudinal row of nozzles which extend laterally from the axis of said additional nozzle tube.

5 Claims, 10 Drawing Figures

FIG.1
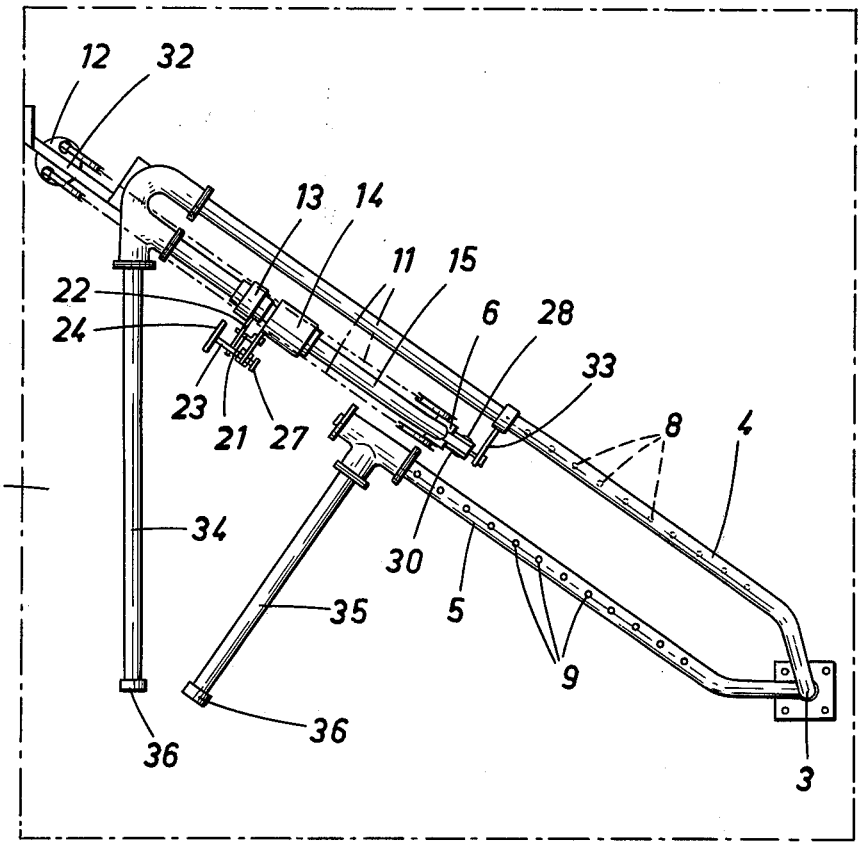
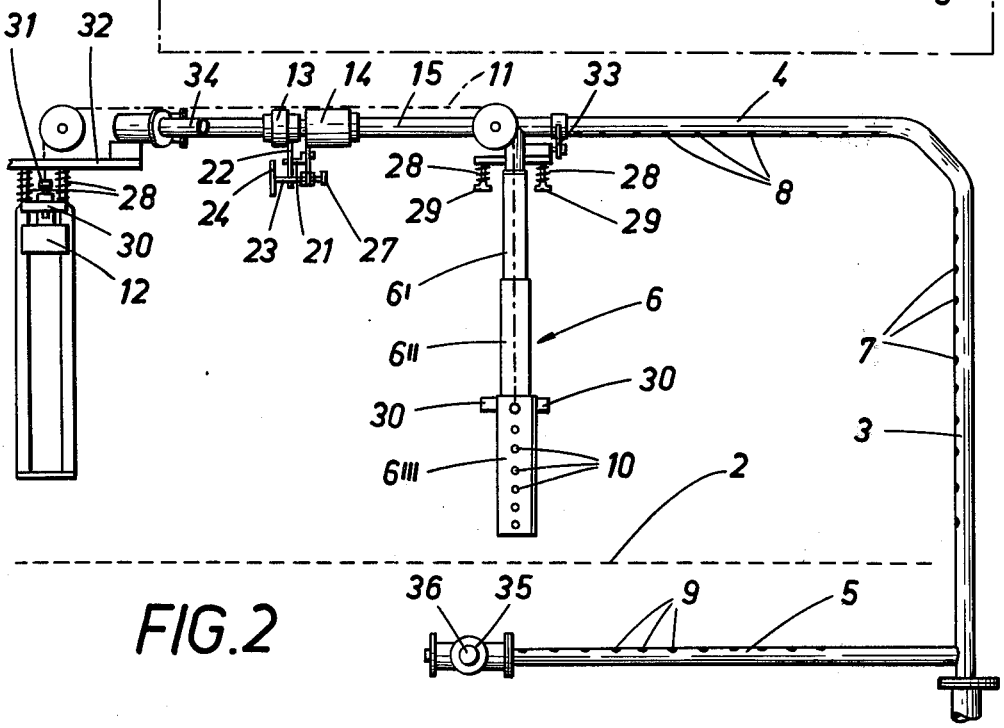
FIG.2

FIG.9
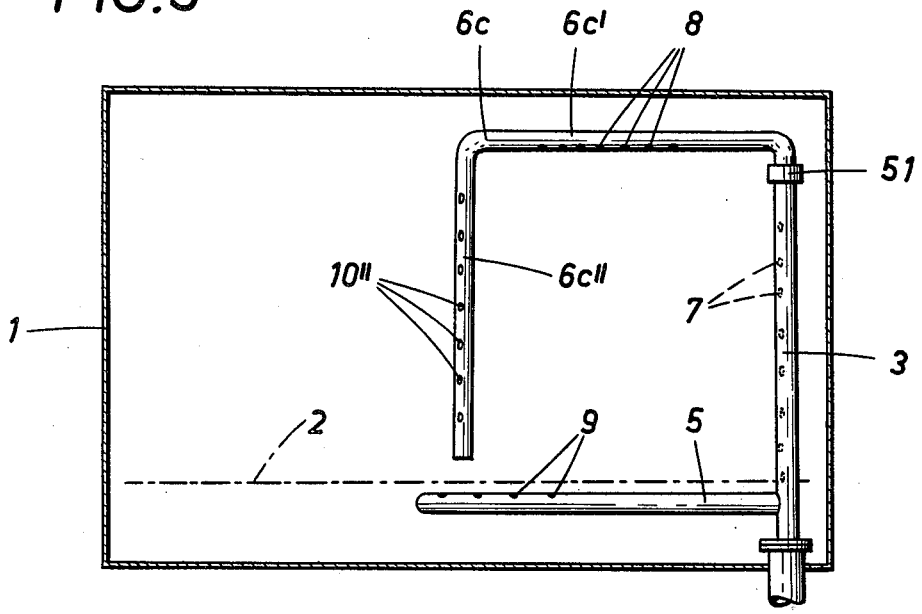
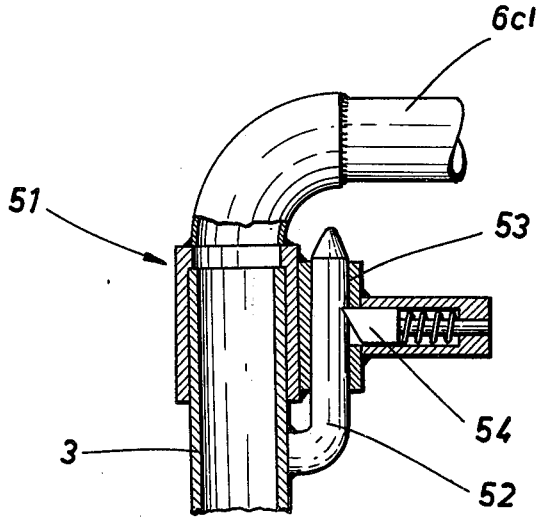
FIG.10

SPRAY-CLEANING APPARATUS

This invention relates to apparatus for cleaning and degreasing machine elements and the like, comprising a support for the articles to be cleaned and a nozzle system for spraying a liquid cleaning fluid, which nozzle system comprises at least one laterally disposed, upright nozzle tube and two horizontal nozzle tubes which are respectively disposed above and below the support, each nozzle tube comprising a row of nozzles which are directed toward the support, and the support and the nozzle system being movable relative to each other.

For a rapid, good, and complete cleaning, the spray jets must reach all surface portions of the article to be cleaned. The main difficulty regarding the arrangement of the nozzle system is due to the requirement to avoid dead spaces into which the cleaning fluid cannot be sprayed. In previously disclosed apparatus in which the article to be cleaned while resting on a rotary grate is moved through a plurality of spray curtains which are disposed one behind or beside the other, this problem is solved satisfactorily as far as closed-surface bodies are concerned but these apparatus cannot clean hollow bodies, such as tubes, connecting pipes, brake drums, bearings, bearing elements and the like as thoroughly as is desired because the jets of sprayed cleaning fluid do not uniformly reach the inside surfaces of the hollow body and in part do not reach them at all.

It is an object of the invention to eliminate this disadvantage and to provide apparatus which is of the kind defined first hereinbefore and enables a complete cleaning not only of closed-surface bodies but also of hollow bodies of virtually any desired shape and size.

This object is accomplished according to the invention substantially by the provision of at least one additional nozzle tube, which protrudes into the cleaning zone receiving the support and defined by the other tubes of the nozzle system. During the cleaning of a hollow body this additional nozzle tube protrudes into the cavity of the body. Owing to the relative movement between the support and the nozzle system the use of the additional nozzle tube enables a uniform spraying of cleaning fluid throughout the inside and outside surfaces so that dead spaces can no longer arise and an excellent cleaning effect is achieved.

To improve the action of the additional nozzle tube, the same comprises two mutually opposite rows of nozzles and the nozzles of said rows are staggered. Particularly in the intricate cavities of hollow bodies, this arrangement results in a more intense spraying of the surface with cleaning fluid.

Some embodiments of the invention are shown by way of example on the accompanying drawings, in which FIG. 1 is a top plan view showing the nozzle tube system according to the invention, FIG. 2 is a side elevation showing the system as viewed in a direction perpendicular to the upper and lower nozzle tubes.

FIG. 9 is a side elevation showing cleaning apparatus which embodies the invention and comprises a replaceable combined nozzle tube.

FIG. 10 is a partly sectional view showing a quick-connecting coupling between two nozzle tubes.

Figure 3:
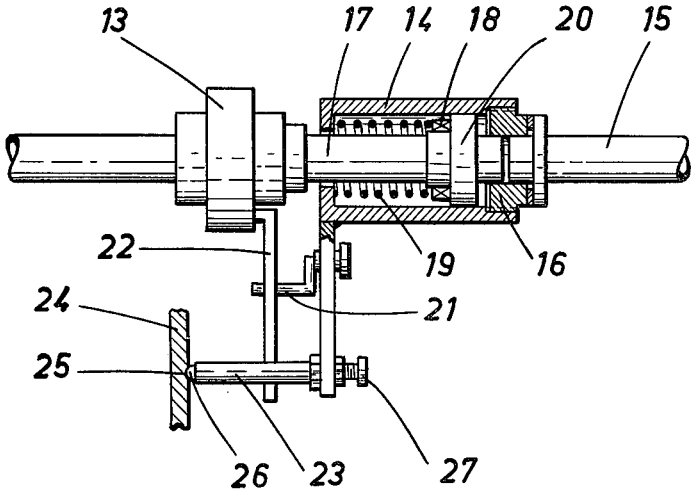
FIG. 3 is an enlarged, partly sectional view showing the pivotal connection between the additional nozzle tube and a supply conduit.

According to FIGS. 1 and 2 the apparatus according to the invention for cleaning and degreasing machine elements and the like comprises a housing 1, which is only diagrammatically indicated in the drawing and contains a rotatable support 2 for the parts to be cleaned and a nozzle system for spraying the liquid cleaning fluid. The nozzle system comprises a laterally disposed, upright nozzle tube 3, two horizontal nozzle tubes 4, 5 which are respectively disposed above and below the support, and a central additional nozzle tube 6, which is connected to the upper nozzle tube 4. This additional nozzle tube 6 depends approximately in the axis of rotation of the support and it free lower end can be telescopically retracted and extended. The lateral, upper and lower nozzle tubes 4, 3, 5 are formed each with a longitudinal row 7, 8, or 9 of nozzles which are directed transversely toward the support 2. The additional nozzle tube 6, which is used for spraying into the cavities of hollow bodies, has two opposite rows 10 of nozzles which are longitudinally offset so that the cleaning fluid is more intensely sprayed in the cavities. By means of a rope-and-pulley mechanism 11, the additional nozzle tube 6 is biased by a counterweight 12 toward the retracted condition. When the supply of liquid is shut off, the counterweight 12 automatically retracts the additional nozzle tube to its uppermost position, and in which the tube is held. It will be understood that a spring rather than the counterweight may be used to bias the additional nozzle tube 6 and will be arranged inside the telescopic part.

The pressure of cleaning fluid flowing into the additional nozzle tube 6 overcomes the weight bias so that the nozzle tube is automatically extended. The additional nozzle tube can be extended to any of a plurality of positions, which are selected in view of the nature and size of the hollow body to be cleaned.

The additional nozzle tube 6 is not required when closed-surface bodies are to be cleaned and the tube 6 can then be shut off by a valve 13.

To prevent a rotation of the sections 6', 6'', 6''' of the additional nozzle tube relative to each other, these tube sections are square in cross-section so that the rows 10 of nozzles cannot be shut off by an unintended rotation of individual tube sections.

The additional nozzle tube 6 is pivoted about a horizontal axis and can be locked in any of several angular positions. As is shown in FIG. 3 the horizontal connecting portion fitting 15 of the additional nozzle tube is non-rotatably held in a housing 14 by a sleeve 16. The housing rotatably surrounds a supply conduit 17 and bears on a collar 20 of the conduit 17 by antifriction bearing 18 under the pressure of a spring 19, interposed between the housing 14 and the bearing 18. Two parallel arms are connected to the housing 14 and are parallel to its pivot axis. One arm 21 engages a lever 22 for operating a valve 13 in the supply tube 17. The other arm 23 serves to lock the housing 14 and additional nozzle tube 6 in a desired angular position. The arm 21 is eccentrically mounted so that its distance from the operating lever 22 can be changed. At its end near a stationary plate 24, the arm 23 carries a ball member 26, which by a spring disposed inside the arm 23 is biased to enter recesses 25 of the plate 24 so as to lock the additional nozzle tube. The stress of the spring which biases the ball member 26 can be adjusted by a screw 27. The additional nozzle tube can be pivoted from the cleaning zone receiving the support 2 between the tubes 3, 4, 5 so that the zone can receive even very large articles. When the additional nozzle tube is raised, the arm 21 automatically closes the valve 13 in the supply conduit.

Figure 4:
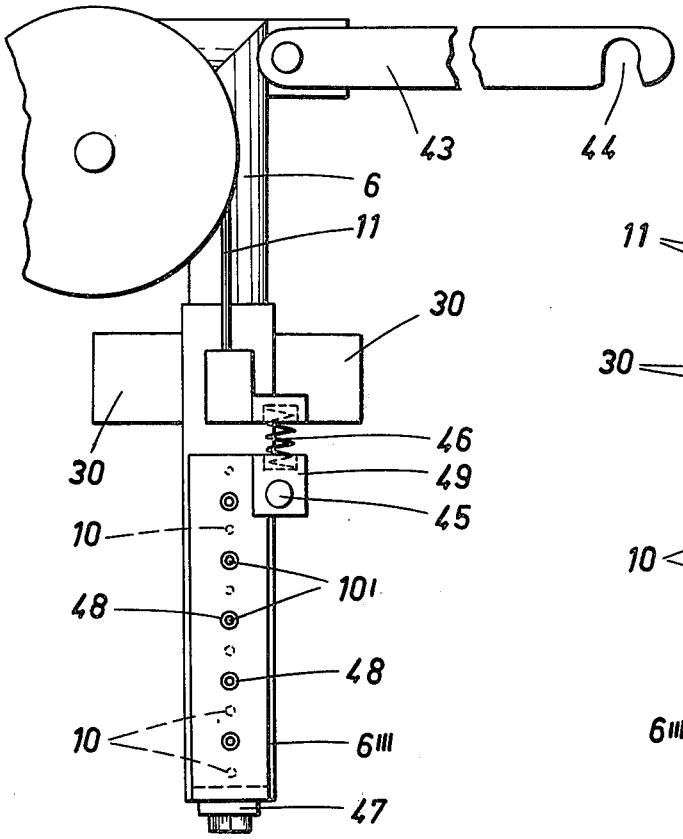
FIGS. 4 and 5 are, respectively, side and end elevations showing on a different scale a shut-off valve for one of the two rows of nozzles of the additional nozzle tube.
Figure 5:
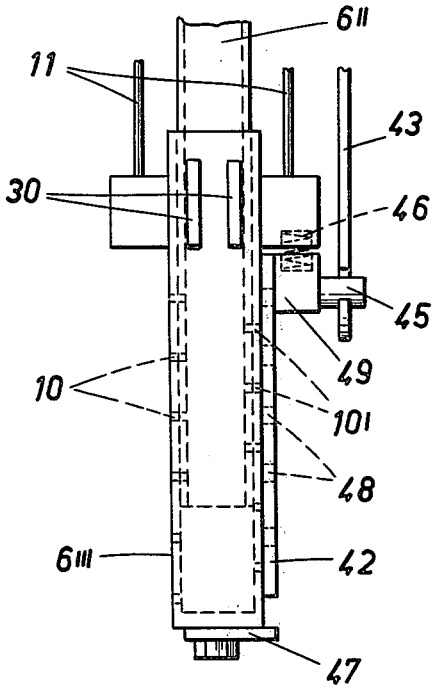

FIGS. 4 and 5 show means for automatically operating a valve plate 42 for one row of nozzles in the tube 6. The non-extensible part of the additional nozzle tube 6 is provided with a locking lever 43, which has an aperture 44 which when the lever is in locking position receives a pin 45, fixed to the valve plate 42. The valve plate is longitudinally slidably mounted on the lowermost telescopic section 6''' of the additional nozzle tube and is biased by a spring 46 against a stop 47 fixed to the tube. As a result, the valve plate is held in its open position, in which holes 48 in the nozzle plate 42 expose the nozzles 10' in one row (FIG. 4). When it is desired to spray cleaning fluid from an inclined tube 6, the telescopic part of the nozzle tube is extended until the locking lever 43 snaps on the pin 45 (FIG. 5). The length of the locking lever will be selected to provide optimum spraying conditions. When the cleaning fluid is supplied, the liquid pressure built up in the telescopic section 6''' will extend this section relative to the locked valve plate 42 against the pressure of the spring 46 until the section 6''' engages the stop 49 whereby the nozzles 10' which are directed away from the support 2 are closed. At the same time, the nozzle holes of the inner and outer telescopic sections 6'', 6''' are in register so that the nozzles directed toward the support are opened. As soon as the supply of liquid is interrupted, the spring 46 contracts the telescopic tube until the valve plate 42 engages the stop 47 to expose the previously closed nozzles. When the locking lever 43 has been disengaged from the pin 45, the additional nozzle tube may be used in the usual manner.

To avoid an excessive shock after the retracting of the tube 6, resilient stops are provided for the telescopic part of the additional nozzle tube and for the counterweight as is best seen in FIG. 2. These stops comprise coil springs 28, which are held and prestressed by screws 29. and the counterweight are provided with forklike projections 30, which by means of the screws 29 can bear on the springs 28. The rope-and pulley mechanism 11 which connects the telescopic section 6''' of the additional nozzle tube 6 to the counterweight 12 can be adjusted by a threaded joint 31. Brackets 32 and cross-members 33 connect the nozzle tubes 4 and 6 to strengthen the tube system. Each nozzle tube is connected to a blind tube 34 or 35, in which the foreign matter is trapped. When it is desired to clean the nozzle system, the closures 36 of these blind tubes 34 and 35 are opened and the entire tube system is flushed through to remove the foreign matter.

Figure 6:
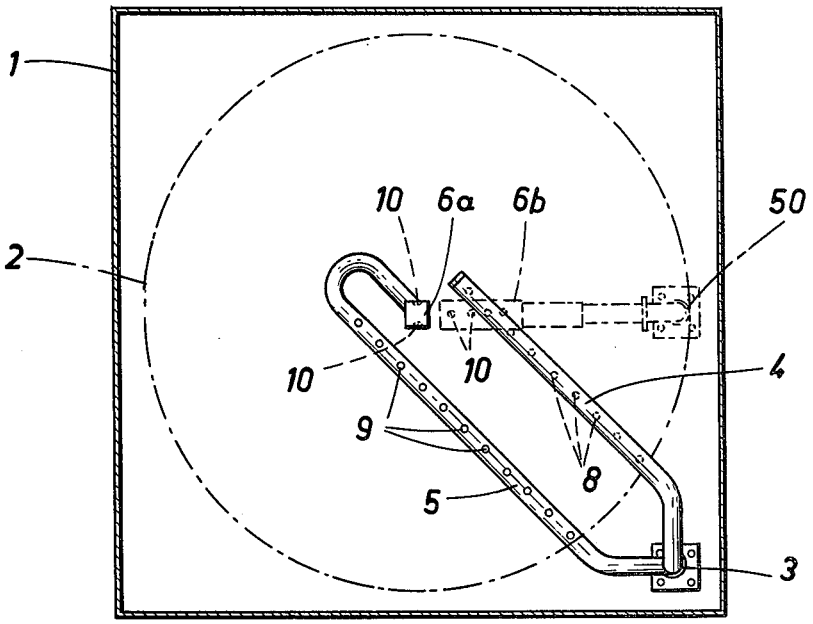
FIGS. 6 and 7 are a top plan view and an elevation showing another embodiment of the apparatus according to the invention.
Figure 7:
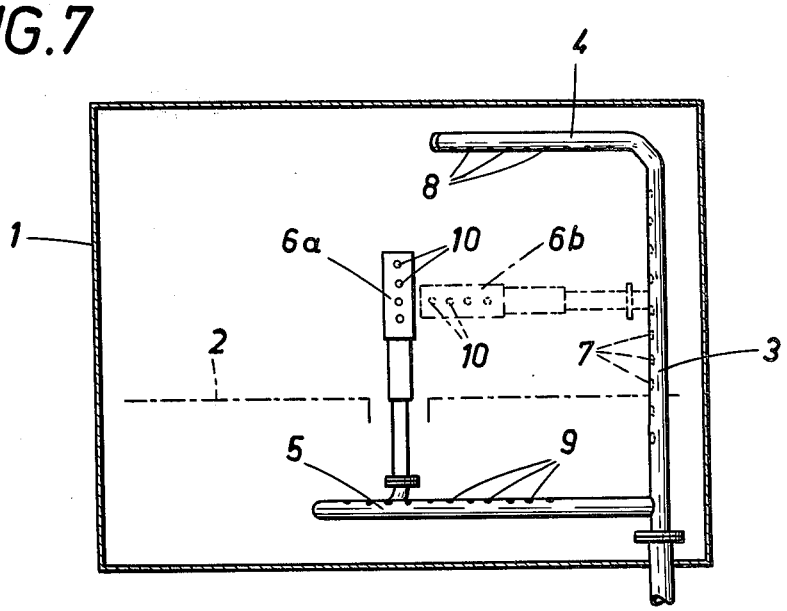

The apparatus according to the invention shown in FIGS. 6 and 7 comprises the nozzle tubes 3, 4, 5 and an additional nozzle tube **6*a*, which extends into the cleaning zone upwardly through the center of the support 2 and can also be telescopically retracted and extended. The additional nozzle tube 6*a* is directly connected to the lower nozzle tube 5** and its free end extends into downwardly open cavities of machine elements which are to be cleaned.

When it is desired to clean articles having lateral apertures and cavities, an additional nozzle tube **6*b* may extend horizontally into cleaning zone from a separate supply conduit 50. This is indicated in dash-dot lines in FIGS. 6 and 7**.

Figure 8:
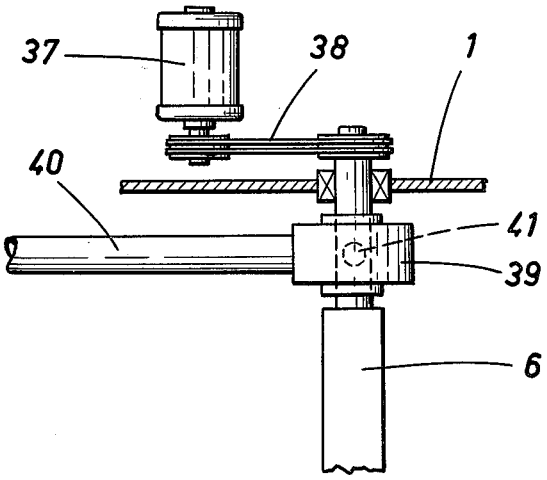
FIG. 8 shows drive means for rotating the additional nozzle tube.

To enable a uniform spraying throughout the surface of articles to be cleaned, the nozzle system and the support must move relative to each other. For this purpose the support 2 consists normally of a rotary grate and is rotated about a vertical axis. If it is impossible or difficult to rotate articles the additional nozzle tube is moved and the article and the support remain stationary. Such an arrangement is shown in FIG. 8, where the additional nozzle tube 6 is rotated about its longitudinal axis by a motor 37 and, a belt drive 38. The tube is rotatably mounted in the housing 1 and in rotary coupling 39. The supply conduit 40 for the cleaning fluid leads into the rotary coupling in which the additional nozzle tube 6 has a radial bore 41.

FIG. 9 shows another apparatus according to the invention in which the upper nozzle tube 4 of the nozzle system may to be replaced by a tube 6c having a horizontal section **6*c'*, which extends approximately to a point above over the center of the support 2, and a depending section 6*c''*. The section 6*c'* has a row of nozzles 8' which are directed toward the support 2. The section 6*c''* has nozzles 10'', which are staggered in two opposite rows. The upper nozzle tube 4 or the tube 6*c* is connected to the lateral upright nozzle tube 3** by a quick-connecting coupling.

The coupling is shown in FIG. 10. The upright nozzle tube 3 and the tube **6*c* are connected by a bell-and spigot joint 51. A locking pin 52 is secured to the nozzle tube 3 and enters an eye 53 on the tube 6*c*. The pin 52 is locked in said eye by a spring-loaded detent 54. The quick-acting coupling may be used alternatively to connect the upper nozzle tube 4 to the lateral upright nozzle tube 3** so that the apparatus can be set up quickly for cleaning either closed-surface bodies or hollow bodies.

What is claimed is:

1. Apparatus for cleaning surfaces of articles by means of a liquid sprayed on said surfaces which comprises:

a. a support for an article to be cleaned;

b. a nozzle system;

c. means for supplying cleaning liquid to said nozzle system, said nozzle system including:

1. an elongated upright tube disposed laterally of said support and upwardly extending beyond said support, 2. an upper, horizontally extending, elongated tube upwardly spaced from said support, 3. a lower horizontally extending, elongated tube downwardly spaced from said support, and 4. an additional elongated tube, i. said upright, upper, and lower tubes each carrying a longitudinal row of nozzles directed toward said support and defining a cleaning zone receiving said support, ii. said additional tube carrying at least one longitudinal row of transversely directed nozzles and having a free longitudinal end in said zone, and iii. said additional tube having two telescopically engaged parts, one of said parts being movable relative to the other part between a retracted and an extended condition;

d. biasing means for biasing said one part toward the retracted condition, said biasing means including a counterweight operatively connected to said one part for simultaneous movement;

e. first resilient stop means engaging said counterweight when said one part reaches said retracted condition; and f. second resilient stop means engaging said one part in the retracted condition thereof, 1. said one part carrying angularly spaced lateral projections, 2. said second resilient stop means including respective coil springs in register with said projections in the direction of movement of said one part, and screws engaging said coil springs and holding the engaged coil springs under initial stress, said projections engaging said screws in said retracted condition.

2. Apparatus for cleaning surfaces of articles by means of a liquid sprayed on said surfaces which comprises:

a. a support for an article to be cleaned;

b. a nozzle system;

c. means for supplying cleaning liquid to said nozzle system, said nozzle system including:

1. an elongated upright tube disposed laterally of said support and upwardly extending beyond said support, 2. an upper, horizontally extending, elongated tube upwardly spaced from said support, 3. a lower horizontally extending, elongated tube downwardly spaced from said support, and 4. an additional elongated tube, i. said upright, upper, and lower tubes each carrying a longitudinal row of nozzles directed toward said support and defining a cleaning zone receiving said support, ii. said additional tube carrying at least one longitudinal row of transversely directed nozzles and having a free longitudinal end in said zone, and d. a quick-connecting coupling detachably connecting said upper tube to said upright tube, 1. said upper tube and said upright tube having respective bell and spigot portions engaged when said upper and upright tubes are connected, 2. said coupling including a locking pin fixed to one of said upper and upright tubes, an eye fixed to the other one of said upper and upright tubes and receiving said pin, and spring-loaded locking means holding said pin in said eye, 3. said additional tube being permanently connected to said upper tube and depending vertically from said upper tube toward the center of said support, 4. said upper tube when connected to said upright tube extending from said upright tube horizontally approximately to a point above said center.

3. Apparatus for cleaning surfaces of articles by means of a liquid sprayed on said surfaces which comprises:

a. a support for an article to be cleaned;

b. a nozzle system;

c. means for supplying cleaning liquid to said nozzle system, said nozzle system including:

1. an elongated upright tube disposed laterally of said support and upwardly extending beyond said support, 2. an upper, horizontally extending, elongated tube upwardly spaced from said support, 3. a lower horizontally extending, elongated tube downwardly spaced from said support, and 4. an additional elongated tube, i. said upright, upper, and lower tubes each carrying a longitudinal row of nozzles directed toward said support and defining a cleaning zone receiving said support, ii. said additional tube carrying nozzles arranged in two opposite longitudinal rows, and having a free longitudinal end in said zone, iii. said additional tube depending toward said support and being centered relative thereto, iv. said additional tube being pivoted about a horizontal axis;

d. locking means for locking said additional tubes in each of several angular positions relative to said axis, the nozzles of one of said two rows being directed away from said support in one of said angular positions; and e. nozzle closing means closing the nozzles of said one row when said additional tube is in said one angular position.

4. Apparatus for cleaning surfaces of articles by means of a liquid sprayed on said surfaces which comprises:

a. a support for an article to be cleaned;

b. a nozzle system;

c. means for supplying cleaning liquid to said nozzle system, said nozzle system including:

1. an elongated upright tube disposed laterally of said support and upwardly extending beyond said support, 2. an upper, horizontally extending, elongated tube upwardly spaced from said support, 3. a lower horizontally extending, elongated tube downwardly spaced from said support, and 4. an additional elongated tube, i. said upright, upper, and lower tubes each carrying a longitudinal row of nozzles directed toward said support and defining a cleaning zone receiving said support, ii. said additional tube carrying at least one longitudinal row of transversely directed nozzles and having a free longitudinal end in said zone;

d. a supply conduit for supplying said liquid;

e. a collar carried by said supply conduit;

f. a housing rotatably surrounding said supply conduit;

g. a bearing mounted on said conduit and interposed between said housing and said collar;

h. compression spring means interposed between said bearing and one of the two parts constituted by said collar and said housing;

i. a fitting connecting said additional tube to said housings, said additional tube being pivoted for angular movement about a horizontal axis, depending toward said support, and being centered relative to said support; and j. locking means for locking said additional tube in each of several angular positions relative to said axis.

5. Apparatus as set forth in claim 4, in which said additional tube is connected to a shut-off valve, valve-operating means are provided, for closing said shut-off valve in response to an upward pivotal movement of said additional tube to a predetermined position, and said valve-operating means comprise a valve-operating lever, a stationary plate formed with recesses, first and second arms carried by said housing and extending approximately parallel to its axis, and a ball member which is carried by said second arm and biased to enter said recesses, said first arm extending adjacent to said valve-operating lever and the distance of said first arm from said lever being adjustable.

* * * * *